US006529131B2

(12) United States Patent
Wentworth

(10) Patent No.: US 6,529,131 B2
(45) Date of Patent: Mar. 4, 2003

(54) ELECTRONIC TETHER

(76) Inventor: Robert E. Wentworth, 1020 Via Impresso, Newbury Park, CA (US) 91320

( * ) Notice: Subject to any disclaimer, the term of this patent is extended or adjusted under 35 U.S.C. 154(b) by 0 days.

(21) Appl. No.: 09/879,621

(22) Filed: Jun. 13, 2001

(65) Prior Publication Data

US 2002/0190861 A1 Dec. 19, 2002

(51) Int. Cl.[7] ..... G08B 23/00
(52) U.S. Cl. ..... 340/573.1; 340/990
(58) Field of Search ..... 340/573.1, 573.4, 340/573.2, 573.3, 502, 503, 504, 524, 989, 990

(56) References Cited

U.S. PATENT DOCUMENTS 4,777,478 A * 10/1988 Hirsch et al. ..... 340/573.3
5,289,163 A * 2/1994 Perez et al. ..... 340/539
5,557,259 A * 9/1996 Musa ..... 340/573
5,892,454 A 4/1999 Schipper et al.
5,900,817 A * 5/1999 Olmassakian ..... 340/573.1
5,905,461 A 5/1999 Neher
5,952,959 A * 9/1999 Norris ..... 342/357
5,963,130 A 10/1999 Schlager et al.
6,014,080 A 1/2000 Layson, Jr.
6,028,514 A 2/2000 Lemelson et al.
6,067,018 A 5/2000 Skelton et al.
6,094,164 A 7/2000 Murphy
6,111,541 A 8/2000 Karmel
6,127,931 A 10/2000 Muhr
6,181,253 B1 1/2001 Eschenbach et al.
6,373,430 B1 * 4/2002 Beason et al. ..... 342/357.09

* cited by examiner

*Primary Examiner*—Daniel J. Wu
*Assistant Examiner*—Son Tang
(74) *Attorney, Agent, or Firm*—Jack C. Munro

(57) ABSTRACT

Apparatus for determining distance and location of a subordinate unit relative to a master unit. There may be a plurality of subordinate units for a single master unit. Both the master and subordinate unit(s) consist of a GPS receiver, RF transceiver, power supply, electronic compass, user interface and microprocessor. The master unit periodically polls and exchanges data with the subordinate unit via a RF transmission. The master unit processes the data and displays it on a display as distance and direction to a subordinate unit. The subordinate unit also processes data and displays it on a display as distance and direction to the master unit. Additionally, the master unit compares the data to user selectable predefined parameters. If the data is not within those parameters, the master unit initiates an alarm condition at both the master and subordinate unit.

3 Claims, 3 Drawing Sheets

ELECTRONIC TETHER

BACKGROUND OF THE INVENTION

1. Field of the Invention

This invention pertains to positioning determining devices, and in particular to devices that enable the position of a person to be determined relative to another person wherein a global positioning system receiver is used to determine the distance, direction and possible elevation distance between another global position receiver with the two devices interacting directly with each other not requiring a monitoring station.

2. Description of the Related Art

There have been many attempts in the past to construct and market an electronic tether. The most common forms of these products have used radio frequency (RF) transmitters and receivers. In this prior art, an individual (subordinate) would carry a portable RF transmitter that would periodically emit an RF signal that would be received by a master unit. The master unit relied upon the signal strength of the RF transmission to determine the proximity of the subordinate unit. If the received signal strength was less than a predefined level, an alert was sounded. These devices lacked the sophistication necessary to accurately determine distance between the subordinate unit and master unit or where the subordinate unit was in relation to the master unit. It is to be understood that a typical master unit would be a parent and a subordinate unit would be a child. A typical environment would be in the wilderness, theme park, shopping mall or in a crowded city.

Recent technology developments permit the monitoring of an individual's location by incorporating a Global Positioning System (GPS). Global positioning uses satellites that are able to accurately fix an individual's location within a few feet in distance. However, the use of this technology has, in the past, required the user to subscribe to monthly monitoring services. Such a method does not and cannot address the need for a parent, guardian or caregiver to be notified immediately if the individual under their supervision has traveled beyond a safe predetermined distance. Further, this method does not facilitate the use of location identification as a portable, use as needed, monitoring device. Another use of the GPS is to use two portable devices, master and subordinate, each equipped with a GPS receiver and the capability of the subordinate unit to transmit its location as defined by signals it receives from the GPS. In this implementation, the ability to locate an individual is dependent upon the fact that both the caregiver and the supervised individual's device must be receiving GPS signals.

The prior art systems have many disadvantages. First, with reference to a device that relies solely on signal strength to determine range, these devices cannot compensate for signal strength variations that occur in one's surroundings. That is to say, RF signals do not always arrive at a receiver with predictable strength in all locations. We know, for example, that signal strength at a particular distance in open space will be significantly different from the same transmitter when it is moved from open space to compartmentalized spaces of buildings. Therefore, an individual, such as a child, moving from an open play area within his safe zone to a playground maze or other type of structure, also within his safe zone, may cause nuisance type alarms because of signal attenuation. Secondly, devices that rely solely on data received from GPS satellites are subject to the availability of the GPS signal. However, depending upon the terrain and other obstructions, a temporary loss of signal can and does occur. In this situation, there would be an inactive period until the GPS receiver reacquires position information. During this temporary interruption of signal, the whereabouts of the child would be unavailable.

SUMMARY OF THE INVENTION

The system of this invention uses GPS receivers combined with RF transceivers and proprietary software. Both master and subordinate portable units are composed of a GPS receiver, RF transceiver, power supply, electronic compass, user interface and microprocessor. The units of this invention may be packaged as user wearable compact devices. In another embodiment, the master unit of this invention is capable of being connected to a fixed position base unit that is interfaced with a personal computer.

The operation of the system of this invention begins with the programming of the master unit and its associated subordinate unit(s). By utilizing the user interface, the units are placed in a program mode. This program mode facilitates the identifying of subordinate unit(s) by the master unit, and the identification of the master unit by the subordinate unit(s). Unique identification information contained in each master and subordinate unit are exchanged during the set-up stage of the user program. The information exchanged is kept in memory of the master and subordinate units. The exchange and storage of this information is to assure that when multiple users of the invention are in close proximity to each other that only those units programmed to be a "family" will communicate with each other. While in the programming mode, the master unit will identify each subordinate's unique identification number and will place in memory the identification number for each subordinate unit in its family. Subsequent to programming the master and subordinate unit(s) as a family, the master unit is programmed through the user interface to alert the master if the subordinate unit(s) has traveled beyond a selected distance. The user selected distances, of pre-established values have been optimized for system accuracy. In some embodiments of the subordinate unit(s), it is possible to program similar distance monitoring, measurement and notification as that of the master unit.

Once placed in service, the master and subordinate unit(s) will acquire information from the available GPS satellites. This data is placed in temporary memory. Upon completion of the acquisition process, the master unit will begin polling or interrogating the subordinate unit(s) by means of the RF transceiver. The subordinate unit(s) receiving the request from the master unit will respond by means of the RF transceiver, with the current or stored GPS coordinates. Included in this transmission will be the time that those coordinates were stored in temporary memory and the time of the response (transmission) to the polling request. Upon receipt of the polling response from the subordinate unit(s) by means of its RF transceiver, the master unit will calculate the distance to the subordinate unit(s) based upon the coordinates of the subordinate(s) with regard to the current coordinates of the master unit, compare that distance to the selected allowable range, and immediately display, and continuously display, the distance to and direction of travel to each subordinate unit. This process continues as long as the devices are in service. The continuing process of polling, receiving and calculating distance provides constant visual indication of the distance to a subordinate unit with regard to the position of the master unit. Depending upon the type of display used in a master unit, the location information of each subordinate unit may scroll automatically or manually at the discretion of the master user. As an important part of this invention, the proprietary software not only references the calculated distance to each subordinate unit against the user selected allowable range, but will reference the time associated with the coordinates that were transmitted by the subordinate unit(s) response.

The time associated with the received coordinates of a subordinate unit may be critical in determining the validity of the calculated distance to the subordinate unit(s). Whereas GPS signal availability could become temporarily unavailable, system design provides for alternate methods of determining distance that can be used in redundancy with valid GPS data or can determine distance independently of the availability of the GPS data. As previously stated, the devices will acquire data from available GPS satellites. This data is stored in temporary memory of the master and subordinate unit(s). At periodic intervals determined by the proprietary software, each unit receives new GPS data and replaces previously stored GPS coordinates with fresh data. Each time data from the GPS is placed in temporary memory, the time of that data is also placed in temporary memory. As the master unit queries a subordinate unit, the subordinate unit will respond with a fresh set of coordinates as it is being received from the GPS satellites. Should the subordinate unit be in a location where GPS signal is temporarily unavailable for the current coordinates at the time it is being queried, it will transmit the coordinates that have been stored in temporary memory along with the time that the coordinates were received and stored. The master unit, upon receipt of the subordinate unit response, will compare the received information time stamp to current time and determine if it is current data or stored data according to the time variance. The proprietary software will determine if the data is acceptable as current, according to predefined safety windows. If the data is accepted as valid current data, the master unit calculates the distance to the subordinate unit with regard to the current location coordinates of the master unit. The distance and direction to the subordinate unit(s) is displayed on the master unit.

In the event that the proprietary software of the master unit determines that the received coordinates from the subordinate unit is too old, it will again query the same subordinate unit(s) in an effort to gain current GPS coordinates. If the subordinate fails to respond with an acceptable time stamp return of coordinates for calculation by the master unit, the master unit will evaluate the received signal from the subordinate unit(s) according to time of arrival of the response with reference to the time of the request and determine distance according to algorithms established for this purpose. The master unit will then compare the results of this algorithmic procedure to the distance calculated by the last received GPS coordinates, and if determined to be similar in distance, and within the defined safe zone, continue to display the distance to and direction to travel to the subordinate unit. In the event that the master unit determines that the calculated distances of the two methods exceed the parameters of acceptability, an alert signal will be initiated on the master unit. The user display will indicate the last known distance to and direction to travel to reach the subordinate unit(s). The alert indication will remain active until the master unit receives current data that is calculated by either or both methods of range determination to be acceptable. Polling of units that are in the acceptable range with valid coordinates continue to be updated as normal during the alert caused by one or more of the subordinate units.

In addition to the master units ability to continuously display the distance and direction to travel to subordinate unit(s), the subordinate unit(s) will display the distance and direction to travel to the master unit. In one embodiment, the subordinate unit is enabled to display the information in the following method: In the normal polling cycle initiated by the master unit, the subordinate is requested to respond with it's coordinates. The master unit receives the data, performs the calculation routine, determines distance and direction to travel to that subordinate unit and displays that information on it's own display. Now, facilitated by the unique address of each subordinate unit that is retained in memory, the master unit will transmit a data stream to the subordinate unit that consists of the distance between the subordinate unit and the master unit, and the direction to travel to reach the master unit. This information is then displayed on the subordinate unit.

In another embodiment of this invention, the master unit transmits its' coordinates during each polling cycle, and each so enabled subordinate unit, containing similar processing capabilities as that of the master unit, will calculate and display the distance and direction to travel to reach the master unit.

Both master and subordinate units contain an emergency call feature whereby the user may manually trigger an RF transmission causing the current or last stored location to be transmitted from the master to the subordinate, or from subordinate to master causing an alert at the other unit. When initiated by the master unit, the user may selectively call a particular subordinate unit, or all of the subordinate units within the family. When activated, the master unit will send information to the subordinate unit(s) that includes distance and direction to travel to reach the master user. When the subordinate unit initiates a call alert, the alert indication is activated at the master unit and information is refreshed at the master unit as to the current location of the subordinate unit. Also included in the displayed information on the master unit is the identification of the subordinate unit that activated the alert. As in other operating conditions,the devices continue to update location information as the master unit moves toward the location of the subordinate unit and the subordinate unit moves in the direction of the master unit.

Subordinate units in some embodiments of this invention employ the use of a tamper or supervisory switch that provides notification to the master unit should the wearer of the subordinate unit remove the unit from their body after the system has been put in use. As in other transmissions, the notification is in the form of an RF transmission containing the distance to and direction of travel to the subordinate unit based upon the last stored or current location data. The display on the master unit will indicate from which subordinate unit (s) the tamper alert was initiated. As in other operating conditions, the devices continue to update location information as the master unit moves toward the location of the subordinate unit, and the subordinate unit moves in the direction of the master unit.

The master unit display is arranged so that the user, at a glance, can determine that all subordinate units within the family are actively reporting and are within the preset parameters of safety. The display will facilitate the monitoring of a plurality of subordinate units and display in sequence the distance and direction to travel to each subordinate unit. Subordinate units may be identified upon the display as alphanumeric or by the use of icons. The master unit display will be capable of indicating several supervisory conditions that are transmitted from the subordinate units during routine polling cycles. These supervisory conditions include, but are not limited to loss of signal, low battery and tamper.

The proprietary communications protocol of the invention dictates the rate or frequency of the polling cycle of the subordinate unit(s) by the master unit. This polling rate has been optimized to maximize the battery life of the units. Provisions are made for the polling rate to be accelerated during events that demand more frequent location updates. These events include, but are not limited to: preprogrammed distance exceeded, activation of the emergency call feature, activation of the supervisory switch and loss of signal from any unit. When the polling rate has been accelerated due to any or all of these conditions, the alert indication at the master and subordinate unit(s) is temporarily inhibited to avoid nuisance alarm. Upon the verification of the unacceptable condition through subsequent exchanges of data, or lack of data, during the accelerated polling cycle, the appropriate alert signal is initiated. The master unit will continue polling at the accelerated rate, updating information from the subordinate unit(s) that caused the alert condition. This process continues until such time that the alert condition has been resolved and manually acknowledged by the user of the master unit. Following the resolution and acknowledgement, the units will return to the normal battery conserving polling rate.

During alert conditions, the master unit will continuously update the information on its display so as to facilitate prompt location of the subordinate unit. The master unit transmission to the subordinate unit will also update the distance and direction the subordinate unit is to travel to reach the master unit.

The units operate on approved RF channels, and the transmission schemes utilize a proprietary digital communications protocol to facilitate very short message packets. The polling cycle of the units is determined by the number of subordinate units under the supervision of the master.

Both the master and subordinate units are designed to make optimal use of their available battery power to minimize battery replacement or recharging. Preferred embodiments of both the master and the subordinate units may incorporate rechargeable battery sources, which do not require removal from the unit. The master unit being larger in size may employ the use of a plug-in charging device. The subordinate unit may employ a unique charging connection developed for this invention. The strap or connection used to attach the subordinate unit to the child or person being supervised may perform the dual service of a tamper device and as the connection to the battery charger. In normal operation, the strap or connector is a closed loop tamper switch. When recharging of the battery is necessary, the open ends of the strap or connector will be inserted into a special charging device.

Additionally, to further conserve battery life when the subordinate unit is not being used, it is desirable to turn off all or a portion of the functions of the subordinate unit. However, due to the nature of this device, it is impractical to provide for a simple on/off switch which could be activated by the child. In a preferred embodiment of the system, the subordinate unit could be powered on by depressing a switch on the subordinate unit. To power down the subordinate unit would require a power down command to be entered through the user interface of the master unit. The master unit would then transmit a properly coded power down instruction to the subordinate unit which would receive the transmission and verify its authenticity before powering down.

It is the object of this invention to overcome the weaknesses of the prior art inventions so that a parent, guardian or caregiver may monitor the location of the child or individual under their supervision with confidence.

It is the object of this invention to overcome the weakness of radio transmitting devices that measure signal strength. It is a known fact that such devices that rely solely upon signal strength for distance measurement are less than reliable at times. Due to various conditions, such as building construction, other radios in close proximity, secondary reflections caused by stationary or moving objects or even trees in heavily wooded areas, received signals can vary significantly in strength.

The subject invention eliminates the need for central station monitoring and the fees associated with such a service.

It is also the object of this invention to reduce the time involved to locate a child or other person using the device by presenting the information necessary to resolve the alarm to both the caregiver and the subordinate user simultaneously.

It is also an objective of this invention to overcome a loss of GPS signal. In such an instance, the master unit and subordinate unit are capable of referring back to the previously stored GPS signal which has been retained in memory. The referring to prior GPS location signals from the memory is to occur only for a certain pre-established period of time. Once that time is exceeded and still a current GPS signal can not be received, both the master unit and the subordinate unit will utilize an alternate method of distance determination, such as time interval measurement.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
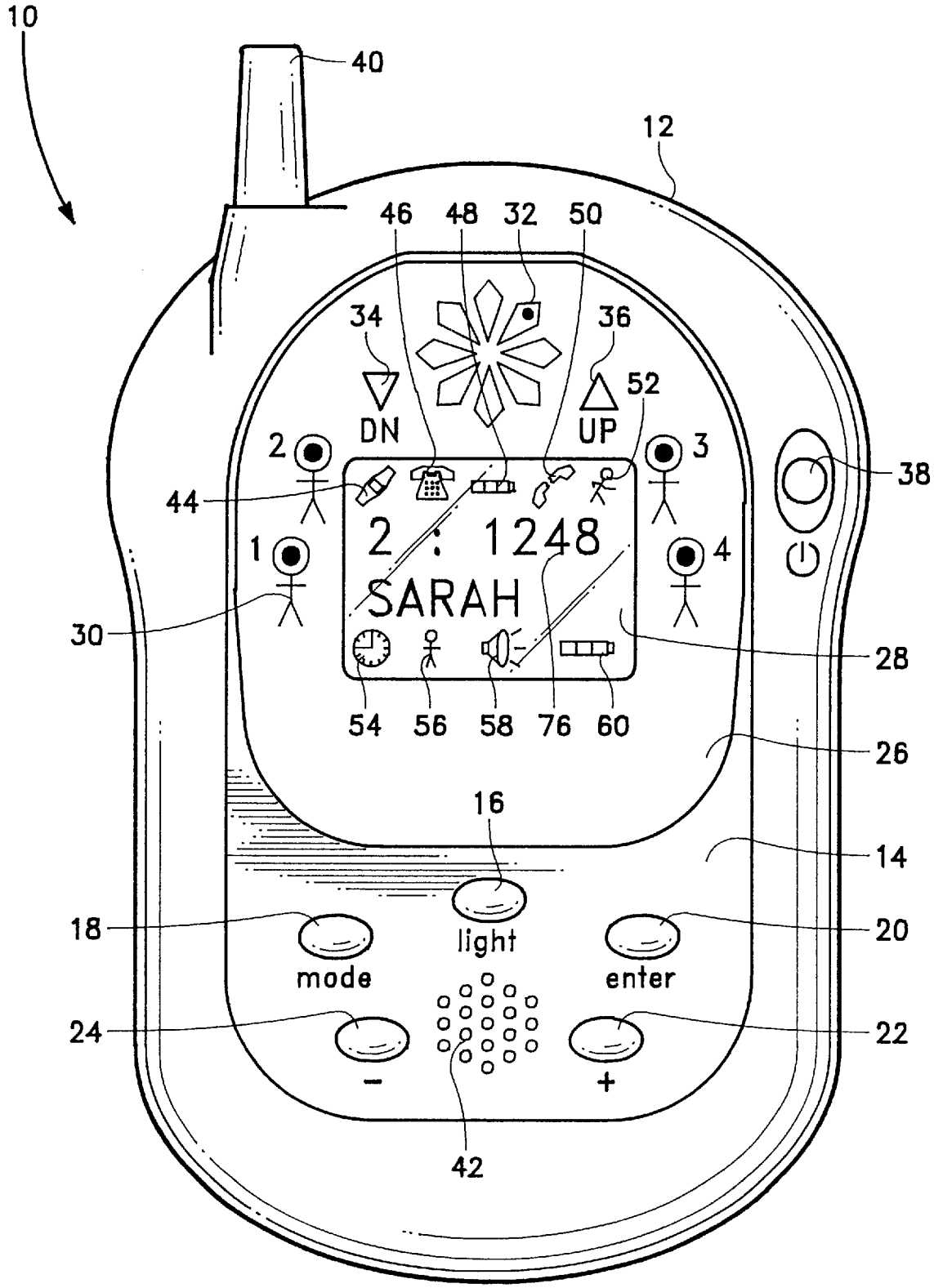
FIG. 1 is a front view of a master unit that is utilized in conjunction with the electronic tether of the present invention.

Referring particularly to FIG. 1 of the drawings, the electronic tether of the present invention utilizes a master unit 10 which includes a plastic housing 12. The plastic housing 12 includes a faceplate 14. Formed within the faceplate 14 are a series of switches 16, 18, 20, 22 and 24. Also included within the faceplate 14 is a display area 26 which includes a display screen 28 and a series (four in number) of figure icons 30, a direction indicator 32, a down icon 34 and an up icon 36. Figure icons 30 can either be not illuminated or if illuminated green there is no problem associated with that child, and if a red color, indicative of an alarm situation associated with the particular child for that icon. Included within the housing 12 is an on/off switch 38. Mounted in conjunction with the housing 12 is also an antenna 40. The faceplate 14 also includes a hole pattern 42 which is connected with an audible annunciator, which is not shown.

The display screen 28 includes a watch icon 44, a phone icon 46, a battery indicating icon 48, a broken phone handset 50 and a running figure icon 52. The display screen 28 also includes a clock face icon 54, a stationary figure icon 56, a speaker icon 58 and a second battery indicating icon 60.

Figure 2:
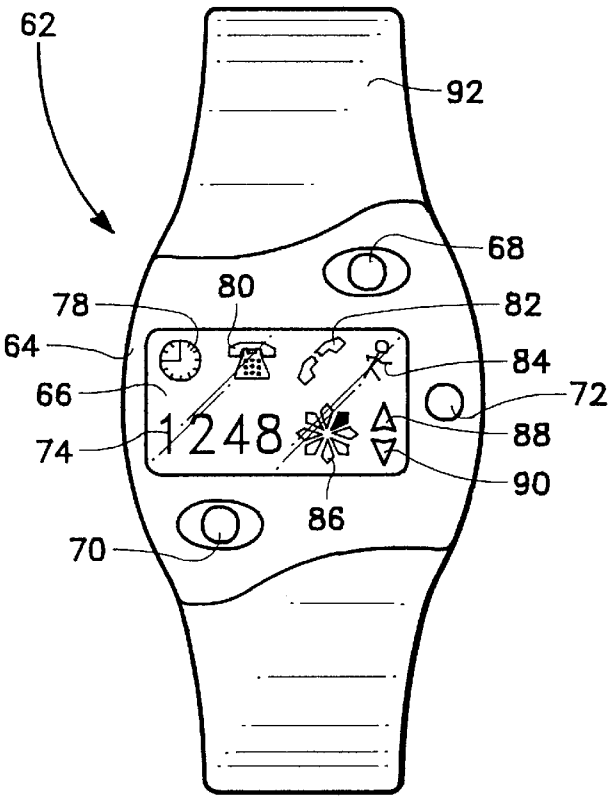
FIG. 2 is a front view of a subordinate unit that is utilized in conjunction with the electronic tether of the present invention.

Referring particularly to FIG. 2 of the drawings, there is shown a front face of a subordinate unit 62 which also has a housing 64. The housing 64 includes a display screen 66. The housing 64 has a call button 68 and a mode button 70. There is also included within the housing 64 an alarm light 72.

The display screen 66 is capable of representing numerical indicia 74 with similar numerical indicia 76 being shown on the display screen 26 of the master unit 10. Also included within the display screen 66 is a clock face icon 78, a phone icon 80, a broken phone handset icon 82 and a running figure icon 84. The display screen 66 also includes a direction indicator 86, an up indicator 88, and a down indicator 90. There is to be included an antenna within the subordinate unit 62, which is not shown. Probably the antenna will be included within the wrist band 92 of the subordinate unit 62 which will facilitate attachment onto the wrist of the child or other party who will be wearing the subordinate unit 62.

Figure 3:
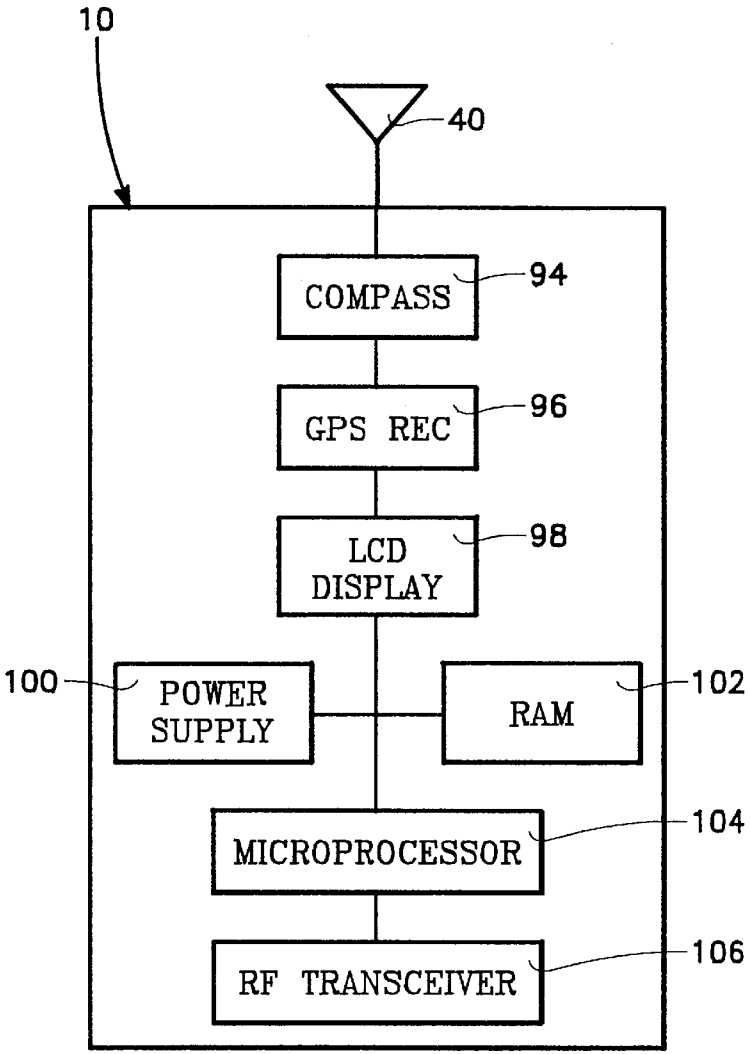
FIG. 3 is a block diagram of the electronics that are utilized in conjunction with both the master unit and the subordinate unit of the electronic tether of the present invention.

Referring particularly to FIG. 3 of the drawings, there is a block diagram of the electronics with the electronics basically being the same both in the master unit 10 and the subordinate unit 62. Therefore, the electronics will include an electronic compass 94, a GPS receiver 96, an LED display 98, power supply 100, a RAM (random access memory) 102, a microprocessor 104 and an RF (radio frequency) transceiver 106.

Figure 4:
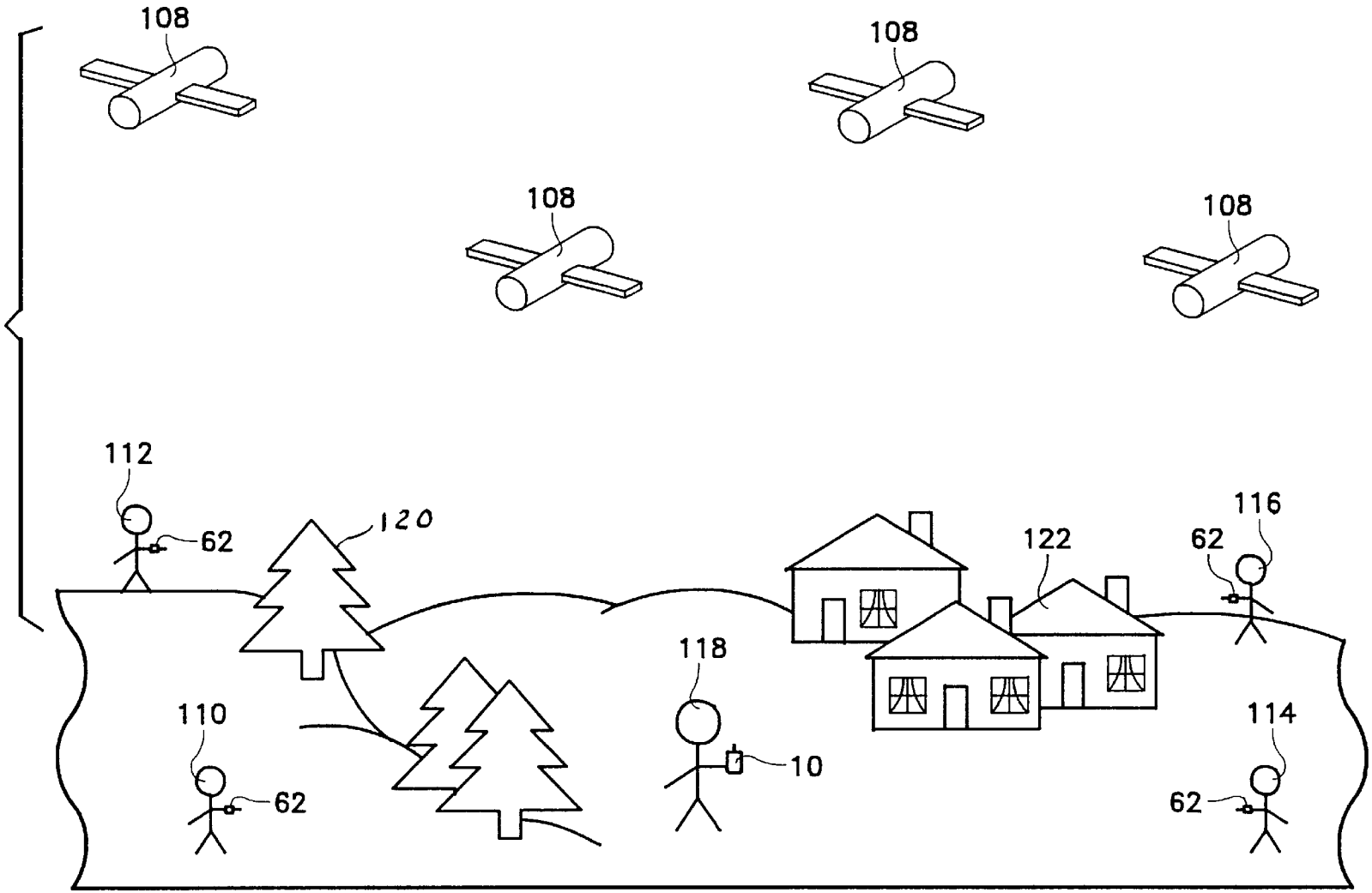
FIG. 4 is a schematic view depicting usage of the electronic tether of the present invention.

Referring particularly to FIG. 4 of the drawings, there is schematically displayed a plurality of orbiting satellites 108 with four in number being shown. There is also represented a child 110 on which has been mounted one of the subordinate units 62. There is also represented a child 112 on which has been mounted a subordinate unit 62. There is a further child 114 which also has attached thereto a subordinate unit 62 with there still being a further child 116 to which it has mounted thereon a subordinate unit 62.

Also depicted in FIG. 4 is a parent 118 which has in his or her possession a master unit 10. Depicted between the location of the parent 118 and the children 110 and 112 are obstructions 120, such as one or more trees. Depicted also between the parent 118 and the children 114 and 116 there is shown obstructions 122 in the form of a series of houses.

The GPS receiver 96 periodically receives signals from the orbiting satellites 108. These signals are processed by an internal imbedded controller (not shown) that calculates location in terms of latitude coordinates, longitude coordinates and, under most conditions, the altitude of the master unit 10 and each subordinate unit 62. This data is stored in flash RAM 102 along with the time that the coordinates were received and placed in memory.

Microprocessor 104 will, at predetermined intervals, initiate an RF transmission by the transceiver 106 to query the subordinate unit(s) 62 within the family of units. The query, short data packets containing the unique address of the master unit 10 to which the subordinate unit(s) 62 have been previously programmed to respond, will request each subordinate unit 62 to respond, one at a time according to the address contained within the message packet. The RF transceiver 106 will also modulate a reference signal. The master unit 10 then waits for response from each of the subordinate units 62 in sequence.

The RF receiving antenna 40 is tuned to the GPS satellite broadcasting frequency for receiving clock signals from the orbiting GPS satellite transmitters 108. The time from the satellites 108 may be displayed on the numerical indicia 74 and 76 if the time display function is selected. In that case, the clock icons 54 and 78 will be displayed to indicate that the clock display has been selected instead of the distance display. The master unit 10 and each subordinate unit 62 further contains a power supply 100, an electronic compass 94, an LCD display 98 and a microprocessor 104.

Each subordinate unit 62, when polled by the master unit 10, will respond with a data packet containing the latitude and longitude coordinates and the altitude, if available. The data for the response is taken from the RAM 102 along with the time that the data was placed in memory. Master unit 10 receives the message packet verifying the unique address of the polled subordinate unit(s) 62, processes the coordinates of the subordinate unit(s) 62 and compares the reported position of the subordinate unit(s) 62 to its current position as stored in the RAM 102. The microprocessor 104 of the master unit 10 computes the distance to the subordinate unit 62 based upon the GPS calculated coordinates and determines the direction of travel for the user of the master unit 10 to reach the subordinate unit 62. This distance and direction is then displayed on the LCD display 98 of the master unit 10. After accepting this data as valid within the program parameters of the system, an acknowledgement is transmitted to the reporting subordinate unit(s) 62. The acknowledgement contains the unique address of the intended subordinate unit 62 and a computed distance and direction of travel for the polled subordinate unit 62 to reach the master unit 10. This information received at the polled subordinate unit 62 is displayed on the LCD display 98 of the subordinate unit 62.

The polling of the subordinate unit(s) 62 by the master unit 10 continues at predetermined intervals to conserve battery power. The LCD display 98 of the master unit 10 and the LCD display of the subordinate unit 62 are continuously refreshed with the distance and direction to travel to reach the other unit(s).

Controlled by the proprietary software, microprocessor 104 will poll each subordinate unit 62 as established during the system setup. During normal operation, the sequence continues as previously described. However, there are a number of events that are addressed in the proprietary software routines that are exceptions to normal operation procedure. These events include, but not limited to (a) a subordinate unit 62 that does not respond, (b) a subordinate unit 62 that responds with coordinates associated with a time reference older than acceptable, (c) a subordinate unit 62 responding with coordinates that when calculated by the master unit 10 and compared to its current location determines the distance greater than the programmed allowable range, (d) activation of the tamper or supervisory connection, (e) activation of the call feature. While each of these events are critical to the well being of the user of the invention, it is also important to carefully process each event in an attempt to resolve the discrepancy without generating nuisance alarms. Therefore, the sequences of operations for the referenced events are as follows:

(A) A subordinate unit 62 that does not respond. Subordinate unit(s) 62 that do not respond to a polling request will cause the master unit 10 to temporarily interrupt its routine of polling the subordinate unit 62 sequentially and retry the unit that did not respond. During this subsequent polling request, the alert indication at the master unit 10 is temporarily inhibited. If communication with the subordinate unit 62 is not re-established, the alert condition is initiated at the master unit and the identification of the subordinate unit 62 and the last reported location of coordinates for the subordinate unit 62 are displayed on the display screen 28 of the master unit 10 and what is displayed is the distance and direction of travel to the last known location. In conjunction with this event, a subordinate unit 62 that does not hear its polling request, or does not receive the acknowledgment from that request by the master unit 10, will activate the alert on the subordinate unit 62 display screen 66 and indicate distance and direction to travel to the last stored location of the master unit 10.

(B) Subordinate unit 62 responds with coordinates associated with a time reference older than acceptable will cause the master unit to temporarily interrupt its routine of polling subordinate unit 62 sequentially and again query the subordinate unit 62 in an attempt to get a current set of coordinates with a current time stamp. Failing to acquire acceptable data, the master unit 10 will utilize the alternate method of distance measurement to determine if the distance, as calculated with time of arrival techniques or other redundant methods, as are commonly used by individuals familiar with the art, is within the acceptable parameters of the system. Time of arrival technique measures distance by the time it takes for the signal to travel from the master unit 10 to the subordinate unit 62 and back to the master unit 10. This calculated data is also compared with the last reported GPS coordinates. If the calculated distance is similar, it is assumed that GPS signals are temporarily blocked. The alert is put on hold, provided the distance calculation is within the pre-programmed safe zone. The master unit LCD numerical display 76 will show the distance and direction to travel to reach the subordinate unit 62 and the master unit microprocessor 104 returns to the normal polling routine sending a normal acknowledgment to the subordinate unit 62.

(C) A subordinate unit 62 responding with coordinates that when calculated by the master unit 10 and compared to its current location determines the distance to be greater than the programmed allowable range will cause the master unit 10 to temporarily interrupt its routine of polling the subordinate units 62 sequentially and again query the subordinate unit 62 in an attempt to resolve the distance discrepancy. The calculated distance, based upon the GPS coordinates, will again be compared to the distance determination by the alternate measurement technique. The alert indication is inhibited during this process. Upon verification of the distance exceeding the preprogrammed safe zone, the alert indication will be initiated at the master unit 10 and the master unit numerical display 76 will display the distance and direction to travel to reach the subordinate unit 62. The return acknowledgement signal to the subordinate unit 62 will cause the alert indication at the subordinate unit 62 to be activated causing lighting of light 72 and the distance and travel to reach the master unit 10 will be displayed at the numerical display 74 of the subordinate unit 62. The master unit 10 will continue to poll the subordinate unit 62 that has exceeded the allowable range at a more frequent rate updating its numerical distance value 74 and direction information on the direction indicator 86 until the subordinate unit 62 is returned to the safe distance. The direction indicator 86 is basically in the shape of a compass rose with a circular array of compass points. If the user looks at the indicator 86 and observes that the point at the one thirty position is illuminated, that tells the user that the user is to walk in that direction from the user's existing position assuming the user is in the center of the direction indicator 96. The master unit 10 will transmit an acknowledgment signal during each polling cycle to the subordinate unit 62 updating the distance and direction information on the subordinate units 62 numerical indicia 74.

(E) Activation of the call feature by pushing of call button 68 on a subordinate unit 62 causes that subordinate unit 62 to transmit an interrupt signal to the master unit 10. This interrupt signal prompts the master unit 10 microprocessor 104 to stop its normal polling sequence and give its attention to the reporting subordinate unit 62. The call signal from the call button 68 is activated on the master unit 10 and the identification number of the specific subordinate unit 62 is displayed with the distance and direction to travel to reach that subordinate unit 62 by the numerical indicia 76. The master unit 10 will continue to poll that specific subordinate unit 62 at an accelerated rate, refreshing the numerical indicia 76 with distance and direction to travel to the subordinate unit 62 and will transmit an acknowledgement signal during each polling cycle to the subordinate unit 62 updating the distance and direction information within the numerical indicia 74.

The electronic tether of the present invention is designed to operate within a certain maximum range. The approximate maximum range would be about a mile. When a user wishes to program the master unit 10, the user presses mode button switch 18. This will now permit the user to set up the range for the desired range parameters. In other words, the parent may decide to set a distance of five hundred yards, and if the subordinate, such as a child, exceeds that range, an alert will occur. The alert could take the form of a vibration and/or activation of an audible alarm. The icon 58, when illuminated, informs the user that the audible alarm is available for activation. When programming in the desired distance to establish as a parameter, the user is to use the plus and minus buttons 22 and 24 respectively which will increase and decrease distance respectively. The audible alarm will emanate from the master unit 10 through the hole pattern 42. The audible alarm can be turned on or off by a sequence of keystrokes. The state of the audible alarm is indicated by icon 58.

The subordinate units are also equipped with an audible alarm. The operation of this alarm can be enabled or disabled by entering a series of keystrokes into the master unit. When this audible alarm is enabled it will accompany the visual alarm indications of the subordinate units.

As part of the programming sequence, the user will select the unit number of the subordinate, the maximum distance that the subordinate unit 62 is to be from the master unit and the name of the subordinate unit 62. This will be all part of the numerical indicia 76. In programming of the particular subordinate unit 62, the user is to press a sequence of buttons or switches 18, 20, 22 and 24 to select a particular subordinate unit 62. The user can then program the total number of subordinate units 62 in a sequential manner by pressing on buttons or switches 18, 20, 22 and 24 and then selecting of the information comprising the numerical indicia for that particular unit by using of plus and minus switches 22 and 24.

The receiving of data of the master unit 10 from the global satellites will automatically cause the time to be programmed within the master unit 10. This time will be displayed when the internal clock icon 54 is illuminated. If a child has removed a subordinate unit 62 from its attached position on the child, the watch icon 44 will be illuminated on the master unit 10 giving an alarm indication. At the same time, the information as to the particular subordinate unit 62 will be displayed and the amount of yards to reach that particular subordinate unit 62 will also be displayed within the numerical indicia 76. At the same time, if the subordinate unit 62 is located at a lesser altitude than the master unit 10, the down icon 34 will be illuminated. If the subordinate unit 62 is at an altitude greater than the master unit 10, the up icon 36 will be illuminated. At the same time, a particular selected compass point of the direction indicator will be illuminated to indicate the relative direction of that particular subordinate unit 62. Regarding the direction indicator 32, the master unit 10 is always at the center of the direction indicator 32.

If a child pushes the call button 68 on the subordinate unit 62, the phone icon 46 will be illuminated on the master unit 10. This will indicate to the parent that the child has pressed his or her call button 68.

If a particular subordinate unit 62 for some reason becomes out of contact with the master unit 10, such as being submerged in water or entering a cave, the broken phone handset icon 50 will be illuminated. The last known position of that particular subordinate unit 62 will also be displayed so the parent can take steps to move to that particular subordinate unit 62. If the child exceeds the preset distance, the running icon Figure 52 will be illuminated which will alert the parent to take steps toward moving toward that subordinate unit 62 with the last known information on the subordinate unit 62 being displayed on the master unit. On the subordinate unit 62 at the same time the alarm light 72 will be illuminated along with running Figure 84 being illuminated. When the icon 50 is illuminated on the master unit 10, the same icon 82 will be illuminated on the subordinate unit 62. If the user of the master unit 10 is making effort to contact the subordinate unit 62, the phone icon 80 will be illuminated on the subordinate unit 62. The subordinate unit 62 will show the time of day if the clock face icon 78 is illuminated. Subordinate unit 62 will display the direction toward the master unit 10 by means of the direction indicator 86. There will be displayed on the subordinate unit 62 the yards to the master unit within the numerical indicia 74.

The battery indicator 48 is to give the indication of the battery power within a particular subordinate unit 62 when the information on the particular subordinate unit 62 is being displayed on the screen 28. The battery indicator 60, if illuminated, will give an indication for a low battery power within the master unit 10. In other words, by the use of the battery indicator 48, the parent can determine if any subordinate unit 62 is low in power.

If a child wishes to change the display mode within the display screen 66, the child only needs to press the mode button 70 which will change the display screen 66 to another mode. One example of a mode change would be to change from time display to distance display. The master unit 10 is to be turned off by pressing of a power on/off button 38. The turning off of each of the subordinate units 62 is accomplished by means of only the master unit 10.

It is to be understood that the master unit and the subordinate unit that are discussed in conjunction with this invention defines modules which include electrical components such as integrated circuits, transistors, capacitors, resistors, and so forth. Such modules are well known in the art and may be constructed in any number of varying circuits employing an available technology or available technologies. Although the master unit has been discussed in relation to parent, the term parent will be defined to include any person charged with the responsibility and care of at least one other individual. Therefore, parent could also be a baby sitter, tour director, doctor, nurse and so forth. The subordinate unit has been discussed in relation to a child. It is to be understood that the term child is to include any individual that is within the control of another individual. It is to be understood that the term child may also include an elderly individual which may have Alzheimers or other mental problems which requires that the elderly individual needs to be in control of a parent.

The subordinate unit is designed to be worn by the child. This wearing could be accomplished by a necklace, bracelet, anklet, belt or by any means that could be used to attach the subordinate unit to the child.

The present invention may be embodied in other specific forms without departing from the essential attributes thereof. Reference should be made to the appending claims rather than the foregoing specification as indicating the scope of the invention.

What is claimed is:

1. A method of operating an electronic tether comprising the steps of:

utilizing a master unit;

utilizing at least one subordinate unit;

placing into a memory of said master unit a unique address identifier of said subordinate unit that is to be supervised by said master unit;

placing into a memory of said subordinate unit a unique address identifier of said master unit to which it is set to respond;

establishing an acceptable distance and programming such into said master unit that a said subordinate unit may travel from said master unit before an alert indication is activated; and including within said master unit a call signal designed to be transmitted to a specific subordinate unit, and, upon activation of said call signal, trigger an alert indication on said subordinate unit which will also cause the displaying of the distance and direction of travel from the subordinate unit to the master unit.

2. A method of operating an electronic tether comprising the steps of:

utilizing a master unit;

utilizing at least one subordinate unit;

placing into a memory of said master unit a unique address identifier of said subordinate unit that is to be supervised by said master unit;

placing into a memory of said subordinate unit a unique address identifier of said master unit to which it is set to respond;

establishing an acceptable distance and programming such into said master unit that a said subordinate unit may travel from said master unit before an alert indication is activated;

initiating an alert signal at said master unit which is transmitted to said subordinate unit;

displaying last known distance and direction to travel from said master unit to said subordinate unit;

generating an alert signal transmission causing said subordinate unit to display said alert signal along with distance and direction of travel to said master unit based upon last known coordinates; and including programming into said master unit a power down instruction that is to be transmittable to said subordinate unit to shut off said subordinate unit.

3. A method of operating an electronic tether comprising the steps of:

utilizing a master unit;

utilizing at least one subordinate unit;

placing into a memory of said master unit a unique address identifier of said subordinate unit that is to be supervised by said master unit;

placing into a memory of said subordinate unit a unique address identifier of said master unit to which it is set to respond;

establishing an acceptable distance and programming such into said master unit that a said subordinate unit may travel from said master unit before an alert indication is activated;

upon failure by said master unit to receive an acceptable polling response from said subordinate unit, the following steps are caused to occur:

verifying an invalid or missing response by repeating the polling procedure;

comparing a last received and stored GPS data within said master unit with time of arrival of a signal from said subordinate unit by use of certain algorithms;

initiating an alert signal at said master unit which is transmitted to said subordinate unit;

displaying last known distance and direction to travel from said master unit to said subordinate unit;

generating an alert signal transmission causing said subordinate unit to display said alert signal along with distance and direction of travel to said master unit based upon last known coordinates;

continuing to poll said subordinate unit attempting to acquire new and valid data from said subordinate unit and updating a display within said master unit accordingly; and resolving an alert condition based on said alert signal by receiving acceptable coordinates from new GPS data or by means of acceptable range determination by time of arrival technique.

* * * * *